US011489291B2

(12) United States Patent
Oosaka et al.

(10) Patent No.: US 11,489,291 B2
(45) Date of Patent: Nov. 1, 2022

(54) BOARD-TO-BOARD CONNECTOR AND CONNECTOR ASSEMBLY

(71) Applicant: JAPAN AVIATION ELECTRONICS INDUSTRY, LIMITED, Tokyo (JP)

(72) Inventors: Junji Oosaka, Tokyo (JP); Yohei Yokoyama, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/223,394

(22) Filed: Apr. 6, 2021

(65) Prior Publication Data

US 2021/0359471 A1 Nov. 18, 2021

(30) Foreign Application Priority Data

| | | |
|---|---|---|
| May 13, 2020 | (JP) | JP2020-084468 |
| May 26, 2020 | (JP) | JP2020-091146 |
| Jun. 12, 2020 | (JP) | JP2020-102280 |
| Jun. 18, 2020 | (JP) | JP2020-105098 |
| Jul. 14, 2020 | (JP) | JP2020-120397 |
| Jul. 16, 2020 | (JP) | JP2020-121984 |
| Aug. 5, 2020 | (JP) | JP2020-132981 |
| Aug. 25, 2020 | (JP) | JP2020-141324 |
| Sep. 16, 2020 | (JP) | JP2020-155230 |
| Sep. 28, 2020 | (JP) | JP2020-161721 |
| Nov. 4, 2020 | (JP) | JP2020-184224 |
| Nov. 4, 2020 | (JP) | JP2020-184235 |

(Continued)

(51) Int. Cl.

| | |
|---|---|
| ***H01R 12/71*** | (2011.01) |
| ***H01R 13/6583*** | (2011.01) |
| ***H01R 13/6585*** | (2011.01) |

(52) U.S. Cl.
CPC ..... *H01R 13/6583* (2013.01); *H01R 12/716* (2013.01); *H01R 13/6585* (2013.01)

(58) Field of Classification Search
CPC ..... H01R 13/6583; H01R 12/716; H01R 13/6585; H01R 13/20; H01R 12/73; H01R 13/6582
See application file for complete search history.

(56) References Cited

U.S. PATENT DOCUMENTS 7,168,986 B1 * 1/2007 Peng ..... H01R 12/716 439/607.04
D562,774 S * 2/2008 Kojima ..... D13/147
(Continued)

FOREIGN PATENT DOCUMENTS

JP 2017-033654 2/2017
TW M257551 U 2/2005

OTHER PUBLICATIONS

Official action dated Jan. 21, 2022 issued in Taiwanese patent application No. 110113044 along with an English translation.

*Primary Examiner* — Abdullah A Riyami
*Assistant Examiner* — Nelson R. Burgos-Guntin
(74) *Attorney, Agent, or Firm* — Greenblum & Bernstein, P.L.C.

(57) ABSTRACT

A cantilever spring is positioned in a slit in a shell, and has a free end and a fixed end fixed to the shell. The cantilever spring extends in a height direction of the shell. The fixed end of the cantilever spring is positioned near a part that is attachable to a board, and the free end of the cantilever spring is apart from that part.

9 Claims, 13 Drawing Sheets

(30) Foreign Application Priority Data

Dec. 8, 2020 (JP) ..... JP2020-005298
Dec. 10, 2020 (JP) ..... JP2020-205016

(56) References Cited

U.S. PATENT DOCUMENTS 7,494,378 B1 * 2/2009 Peng ..... H01R 13/6585 439/607.01
7,585,185 B2 * 9/2009 Obikane ..... H01R 12/716 439/74
7,815,467 B2 * 10/2010 Tsuchida ..... H01R 12/716 439/607.09
8,840,407 B2 * 9/2014 Nose ..... H01R 12/716 439/74
8,968,005 B2 * 3/2015 Hirakawa ..... H02K 15/14 439/65
9,331,429 B2 * 5/2016 Choi ..... H01R 13/6335
9,425,526 B2 * 8/2016 Uratani ..... H01R 12/716
9,755,372 B2 * 9/2017 Ozeki ..... H01R 13/6591
10,084,265 B2 * 9/2018 Ozeki ..... H01R 13/631
10,312,637 B2 * 6/2019 Chuang ..... H01R 12/707
10,312,639 B2 * 6/2019 Chen ..... H01R 12/73
10,498,058 B1 * 12/2019 Kitazawa ..... H01R 13/6594
10,777,941 B2 * 9/2020 Horino ..... H01R 12/71
10,897,097 B2 * 1/2021 Hirakawa ..... H01R 13/115
2006/0063432 A1 * 3/2006 Chen ..... H01R 13/658 439/607.36
2015/0132985 A1 * 5/2015 Choi ..... H01R 13/6335 439/345
2015/0357729 A1 * 12/2015 Uratani ..... H01R 12/716 439/585
2017/0033510 A1 * 2/2017 Ozeki ..... H01R 43/205
2018/0175561 A1 * 6/2018 Chen ..... H01R 12/52
2018/0198241 A1 * 7/2018 Ooi ..... H01R 13/6585
2019/0097360 A1 * 3/2019 Chen ..... H01R 13/6594
2019/0296489 A1 * 9/2019 Nishi ..... H01R 13/631
2020/0161816 A1 * 5/2020 Amemori ..... H01R 13/631
2021/0098943 A1 * 4/2021 Hayashi ..... H01R 13/6587
2021/0167555 A1 * 6/2021 Oosaka ..... H01R 13/6581
2021/0175666 A1 * 6/2021 Zhang ..... H01R 12/716
2021/0218194 A1 * 7/2021 Shimomura ..... H01R 13/6581
2021/0218196 A1 * 7/2021 Shimomura ..... H01R 13/6585
2021/0359437 A1 * 11/2021 Oosaka ..... H01R 13/502
2021/0359440 A1 * 11/2021 Oosaka ..... H01R 12/73
2021/0359456 A1 * 11/2021 Oosaka ..... H01R 13/506
2021/0359458 A1 * 11/2021 Oosaka ..... H01R 13/6582
2021/0359459 A1 * 11/2021 Oosaka ..... H01R 13/6581
2021/0359460 A1 * 11/2021 Oosaka ..... H01R 13/502
2021/0359463 A1 * 11/2021 Oosaka ..... H01R 13/6582
2021/0359469 A1 * 11/2021 Oosaka ..... H01R 12/716
2021/0359471 A1 * 11/2021 Oosaka ..... H01R 12/716
2021/0359473 A1 * 11/2021 Oosaka ..... H01R 13/6585
2021/0359474 A1 * 11/2021 Oosaka ..... H01R 13/6471
2021/0391669 A1 * 12/2021 Okubo ..... H01R 13/641
2022/0052470 A1 * 2/2022 Hosoda ..... H01R 12/7005
2022/0094110 A1 * 3/2022 Okubo ..... H01R 12/73
2022/0140512 A1 * 5/2022 Amemori ..... H01R 13/6581 439/259

* cited by examiner

BOARD-TO-BOARD CONNECTOR AND CONNECTOR ASSEMBLY

TECHNICAL FIELD

The present disclosure relates generally to a board-to-board connector used for parallel connection of two boards and to a connector assembly in which the board-to-board connector and a board-to-board connector as a counterpart of this board-to-board connector are fitted to each other, and in particular to a board-to-board connector and a connector assembly with reduced electromagnetic interference (EMI).

BACKGROUND ART

For connection of two boards, two board-to-board connectors are commonly used. A first board-to-board connector is fixed to one surface of a first board, while a second board-to-board connector is fixed to one surface of a second board. For parallel connection, the first board-to-board connector and the second board-to-board connector are fitted to each other such that the one surface of the first board and the one surface of the second board face each other in parallel. The first board and the second board are electrically connected with each other via a connector assembly in which the first board-to-board connector and the second board-to-board connector are fitted with each other.

As a prior art of such a connector assembly, FIG. 1 shows two board-to-board connectors disclosed in Japanese Patent Application Laid Open No. 2017-33654 (hereinafter referred to as Patent Literature 1). In Patent Literature 1, one of the board-to-board connectors is called a first electrical connector 10 and the other board-to-board connector is called a second electrical connector 20. FIG. 1 is a copy of FIG. 27 of Patent Literature 1.

As shown in FIG. 1, a shell of the first electrical connector 10 has contact pieces 12*i*, which are cantilever springs. With the first electrical connector 10 and the second electrical connector 20 being fitted with each other, the contact pieces 12*i* are in contact with an inner wall surface of a shell of the second electrical connector 20. This contact provides electrical connection between the first electrical connector 10 and the second electrical connector 20. The shell of the first electrical connector 10 is coupled with a ground pad of one of two boards, while the shell of the second electrical connector 20 is coupled with the ground pad of the other board.

As shown in FIG. 1, considering the fitting of the two board-to-board connectors, typically, free ends of the cantilever springs provided in one board-to-board connector are positioned near the board to which the one board-to-board connector is to be attached, while fixed ends of the cantilever springs face the board-to-board connector as the counterpart when the board-to-board connector and the board-to-board connector as the counterpart of this board-to-board connector face each other.

Recent years have seen proliferation of electronic devices such as advanced portable communication devices that are capable of processing at high speed a large amount of digital information like high quality images and video. For processing a large amount of digital information at high speed, high frequency signals are used inside such electronic devices. Within such an electronic device, typically a signal transmission circuit and a large number of small electronic parts are mounted on a board at high density. Thus, it is desirable to reduce intrasystem electromagnetic interference (EMI), in which an electromagnetic wave generated in an electronic part or the signal transmission circuit induces failures of other electronic parts present within the same electronic device.

Here, known ways of conduction of a radiated electromagnetic wave include "conductor conduction", in which the electromagnetic wave conducts in a signal transmission circuit and the like on the board, and "spatial conduction", in which the electromagnetic wave propagates through space. For a board-to-board connector as an electronic part, it is important to block the spatial conduction of an electromagnetic wave from the inside of the board-to-board connector by means of a conductive shell electrically connected with the ground pad of the board.

BRIEF SUMMARY OF THE INVENTION

In light of these technical backgrounds, the present invention provides a board-to-board connector having a shell that effectively blocks the spatial conduction of an electromagnetic wave from the inside of the board-to-board connector and a connector assembly including the board-to-board connector.

The following technical matters are described simply to facilitate the understanding of the main points of the present invention, not to limit the invention claimed in the claims explicitly or implicitly and not to express the possibility of accepting such a limitation that is imposed by a person other than those who will benefit from the present invention (for example, the applicant and the right holder). The general outline of the present invention described from other perspectives can be understood from, for example, the claims of this application as originally filed at the time of application.

In brief, the conductive shell of the board-to-board connector according to the present invention includes a cantilever spring, the cantilever spring extending in a direction opposite to the direction in which the cantilever spring employed in the prior art extends.

More specifically, the cantilever spring is positioned in a slit in the conductive shell and has a free end and a fixed end fixed to the conductive shell. The cantilever spring extends in a height direction of the conductive shell. The fixed end of the cantilever spring is positioned near the board to which the board-to-board connector is to be attached, while the free end of the cantilever spring faces the board-to-board connector as the counterpart when the board-to-board connector and the board-to-board connector as the counterpart of this board-to-board connector face each other.

These and other objects, features and advantages of the present invention will become apparent from the detailed description taken in conjunction with the accompanying drawings.

EFFECTS OF THE INVENTION

The present invention achieves reduction in EMI.

BRIEF DESCRIPTION OF THE DRAWINGS

The subject matter, which is regarded as the invention, is particularly pointed out and distinctly claimed in the claims at the conclusion of the specification. The present invention itself, and manner in which it may be made or used, if any, may be better understood after a review of the following description in connection with the accompanying drawings in which:

LIST OF REFERENCE NUMERALS

Figure 1:
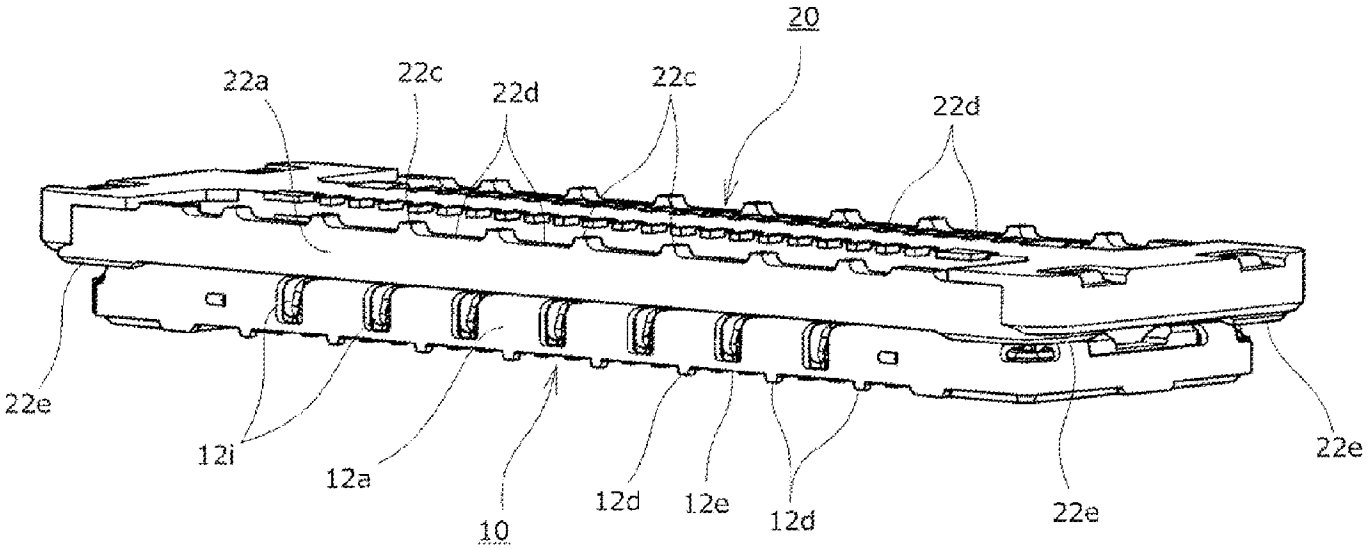
FIG. 1 is FIG. 27 of Patent Literature 1.

With regard to reference numerals used, the following numbering is used throughout the drawings.

1: first board
2: second board
100: first board-to-board connector
110: first shell
110A: first side wall portion
110B: first part
110C: slit
110D: cantilever spring
110E: free end
110F: fixed end
110G: central portion
111: metal part
111*a*: first plate portion
111*b*: second plate portion
111*c*: hook
111*d*: brace
111*e*: convex portion
111*g*: claw
130: first insulator
131: bottom portion
131*a*: center plate portion
131*b*: side plate portion
132: side wall portion
132*a*: concave portion
132*b*: concave portion
150: first contact
150*a*: one end
150*b*: another end
150*c*: one end
150*d*: another end
170: conductor part
170*a*: rod portion
170*b*: wall portion
170*c*: end portion
200: second board-to-board connector
210: second shell
210A: second side wall portion
210B: second part
210*b*: bottom portion
210*b*1: flat plate portion
210*b*2: upright portion
210*b*21: reverse U-shaped portion
210*b*22: bridge portion
210*b*23: leg portion
210*b*24: claw
210*b*25: claw
210*e*: convex portion
230: second insulator
230*a*: groove
230*b*: concave portion
230*c*: slit
230*d*: bridge portion
250: second contact
250*a*: U-shaped portion
250*b*: L-shaped portion
250*c*: U-shaped portion
250*d*: leg portion
500: connector assembly

DETAILED DESCRIPTION OF THE EMBODIMENTS

Referring to FIGS. 2 to 13, structures of a first board-to-board connector 100 according to an embodiment and a connector assembly 500 according to an embodiment are described. The connector assembly 500 includes the first board-to-board connector 100 attachable to a first board 1 and a second board-to-board connector 200 which is attachable to a second board 2 and can fit with the first board-to-board connector 100 (see FIG. 10).

<First Board-to-Board Connector>

Figure 2:
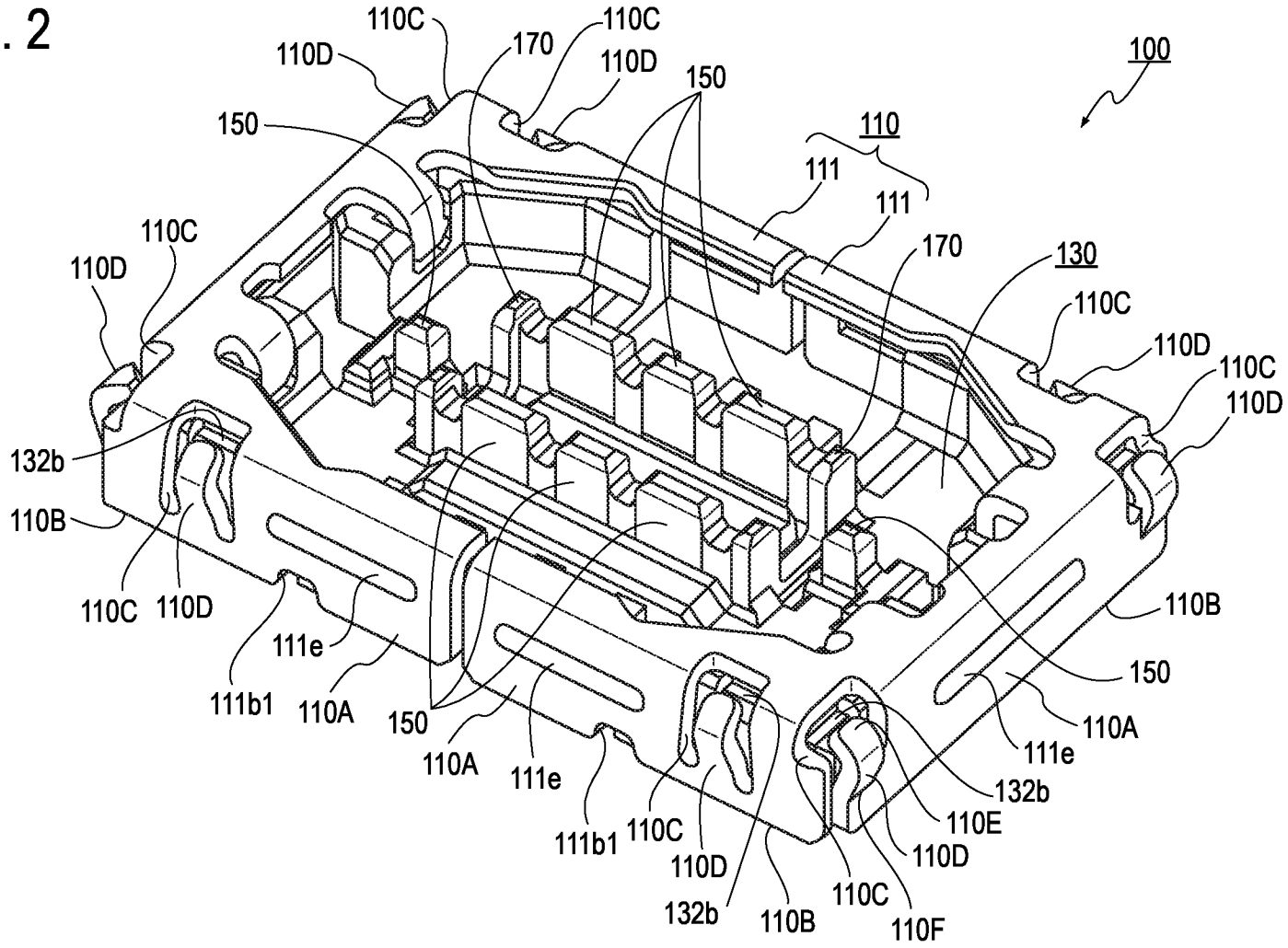
FIG. 2 is a perspective view of a first board-to-board connector when it is seen from diagonally above.
Figure 3:
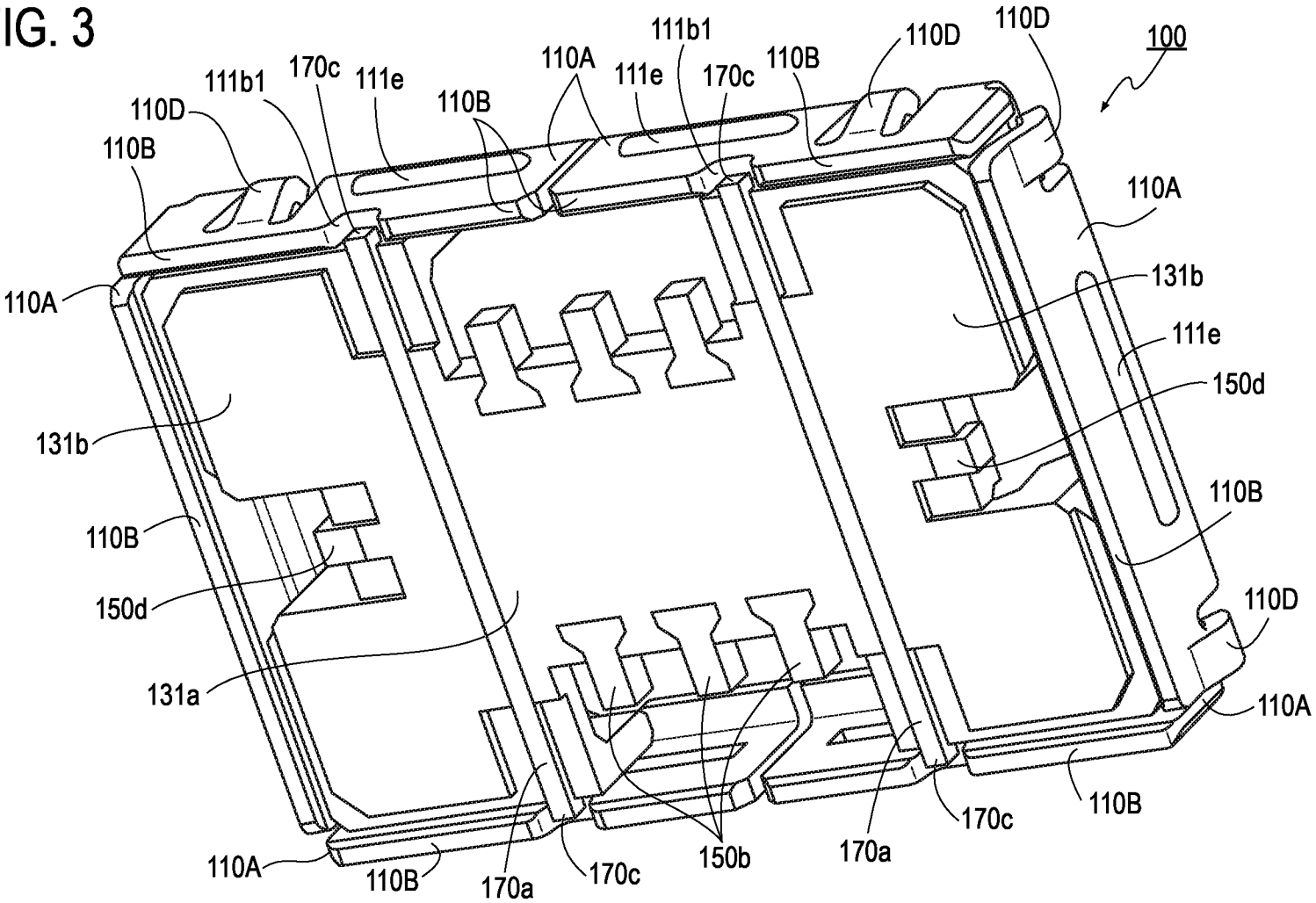
FIG. 3 is a perspective view of the first board-to-board connector when it is seen from diagonally below.

The first board-to-board connector 100 shown in FIGS. 2 and 3 includes a first shell 110 having a frame structure and conductivity, a first insulator 130 having electrical insulation property, eight first contacts 150 each having conductivity, and two conductor parts 170.

<First Insulator, First Contact, and Conductor Part>

Figure 4:
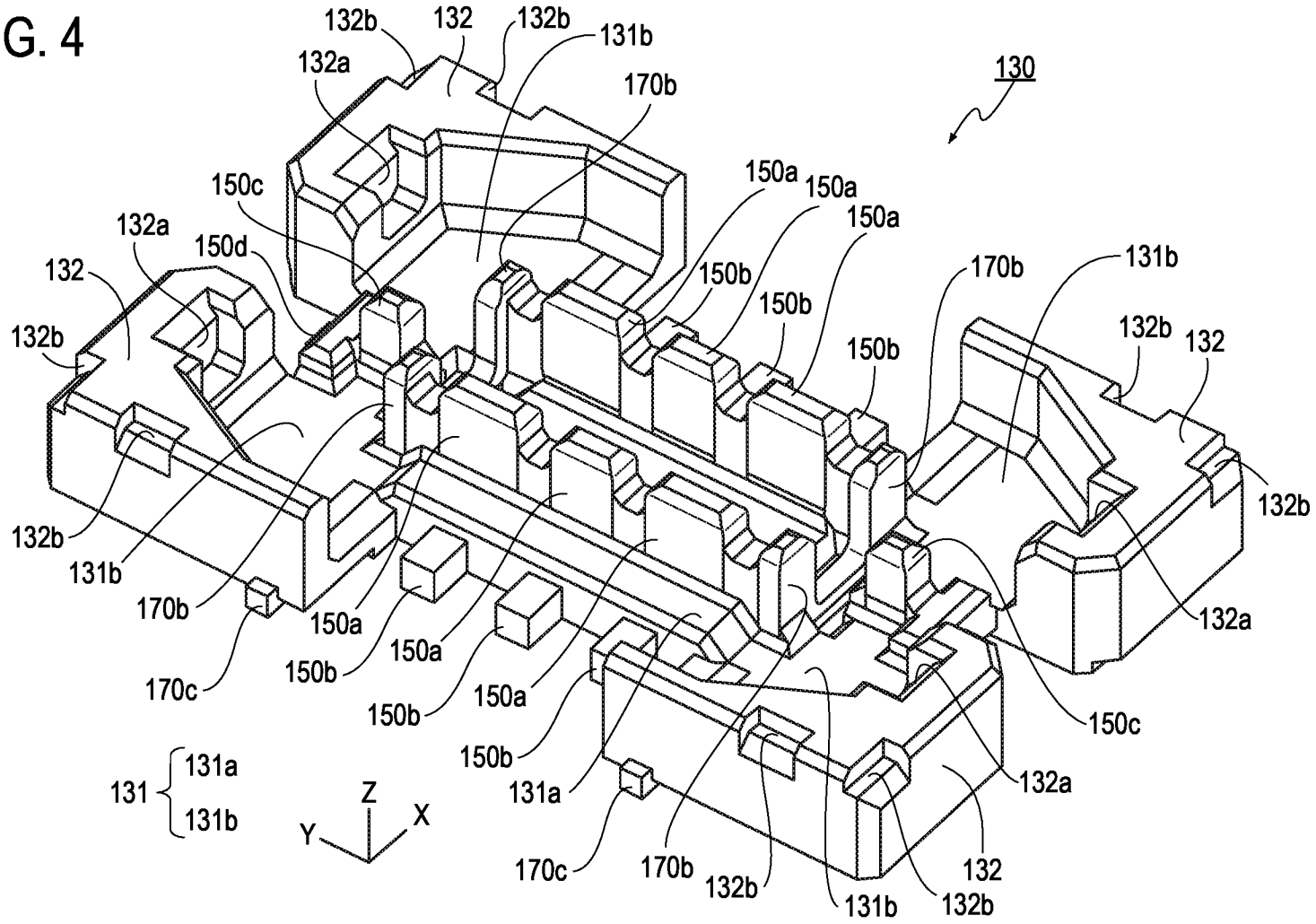
FIG. 4 is a perspective view of a first insulator of the first board-to-board connector.

The first insulator 130 shown in FIG. 4 is a one-piece insulation part, including a flat H-shaped bottom portion 131 and L-shaped side wall portions 132 standing at four corner portions of the bottom portion 131. The four corner portions of the bottom portion 131 at which the side wall portions 132 stand correspond to the four corner portions of the bottom portion 131 when it is assumed to be a rectangle. That is, two side wall portions 132 are positioned in one of two side plate portions 131*b* of the bottom portion 131 across a center plate portion 131*a* of the bottom portion 131, and the remaining two side wall portions 132 are positioned in the other side plate portion 131*b*. The four side wall portions 132 extend from the bottom portion 131 in the same direction (the Z-direction shown in FIG. 4).

For each of the four side wall portions 132, the side wall portion 132 has a concave portion 132*a* on an inside of the side wall portion 132 opposite the center plate portion 131*a* of the H-shaped bottom portion 131. The concave portion 132*a* has an opening in an upper surface of the first insulator 130. "Upper" and "lower" in the description refer to "upper"

and "lower" on a page in a height direction of the first insulator 130 shown in FIG. 4 (that is, the Z-direction shown in FIG. 4). For each of the four side wall portions 132, the side wall portion 132 has two concave portions 132*b* on an outside of the side wall portion 132. Each one of the two concave portions 132*b* has an opening in the upper surface of the first insulator 130.

Six L-shaped first contacts 150 are attached to the center plate portion 131*a* of the H-shaped bottom portion 131, and two L-shaped first contacts 150 are attached to the respective two side plate portions 131*b* of the H-shaped bottom portion 131. The six first contacts 150 attached to the center plate portion 131*a* form two parallel contact rows each having the same number of the first contacts 150. The two contact rows are positioned near the two edges of the center plate portion 131*a*, and a length direction of the contact rows is parallel to the direction in which the two edges of the center plate portion 131*a* extend (that is, Y-direction). A straight line connecting the two first contacts 150 attached to the two side plate portions 131*b* is parallel to the contact rows and passes between the two contact rows.

For each of the six first contacts 150 attached to the center plate portion 131*a*, one end 150*a* of the first contact 150 protrudes from the bottom portion 131 in the direction in which the side wall portions 132 stand, while another end 150*b* of the first contact 150 protrudes from the center plate portion 131*a* toward the outside of the center plate portion 131*a* in a direction parallel to the bottom portion 131 and orthogonal to the length direction of the contact rows.

For each of the two first contacts 150 attached to the two side plate portions 131*b*, one end 150*c* of the first contact 150 protrudes from the bottom portion 131 in the direction in which the side wall portions 132 stand, while another end 150*d* of the first contact 150 protrudes from the side plate portion 131*b*, which the first contact 150 is attached to, toward the outside of the side plate portion 131*b* in a direction parallel to the bottom portion 131 and parallel to the length direction of the contact rows.

In this embodiment, the two first contacts 150 attached to the two side plate portions 131*b* are contacts for high frequency current (high speed transmission), whereas the six first contacts 150 attached to the center plate portion 131*a* are contacts for low frequency current (low speed transmission). The frequency of the high frequency current is hundreds of MHz or higher, for example.

One conductor part 170 is attached to each of the two side plate portions 131*b* of the bottom portion 131. The conductor part 170 is positioned near a boundary between the center plate portion 131*a* and the side plate portion 131*b* to which the conductor part 170 is attached. The one-piece conductor part 170 is made of metal and includes an elongated rod portion 170*a* and two wall portions 170*b* extending perpendicularly from the rod portion 170*a* in the same direction.

The wall portions 170*b* protrude from the bottom portion 131 in the direction in which the side wall portions 132 stand, and opposite end portions 170*c* of the rod portion 170*a* extending in a direction orthogonal to the length direction of the contact rows slightly protrude from the side plate portion 131*b*, which the conductor part 170 is attached to, toward the outside of the side plate portion 131*b* in a direction parallel to the bottom portion 131. One wall portion 170*b* of one conductor part 170 and one wall portion 170*b* of the other conductor part 170 are positioned on an imaginary extension of one of the contact rows, while the other wall portion 170*b* of the one conductor part 170 and the other wall portion 170*b* of the other conductor part 170 are positioned on an imaginary extension of the other contact row.

<First Shell>

The first shell 110 attached to the first insulator 130 shown in FIG. 4 has a frame structure and the first insulator 130 is positioned within the first shell 110 (see FIG. 2). The first shell 110 has a first side wall portion 110A that runs along the first insulator 130. The first side wall portion 110A of the first shell 110 has a first part 110B attachable to the first board 1. The first side wall portion 110A of the first shell 110 has a slit 110C. The first side wall portion 110A of the first shell 110 has a cantilever spring 110D which is positioned in the slit 110C and has a free end 110E and a fixed end 110F fixed to the first side wall portion 110A of the first shell 110. The cantilever spring 110D extends in the height direction of the first shell 110. The fixed end 110F of the cantilever spring 110D is close to the first part 110B of the first shell 110, while the free end 110E of the cantilever spring 110D is apart from the first part 110B of the first shell 110.

Figure 5:
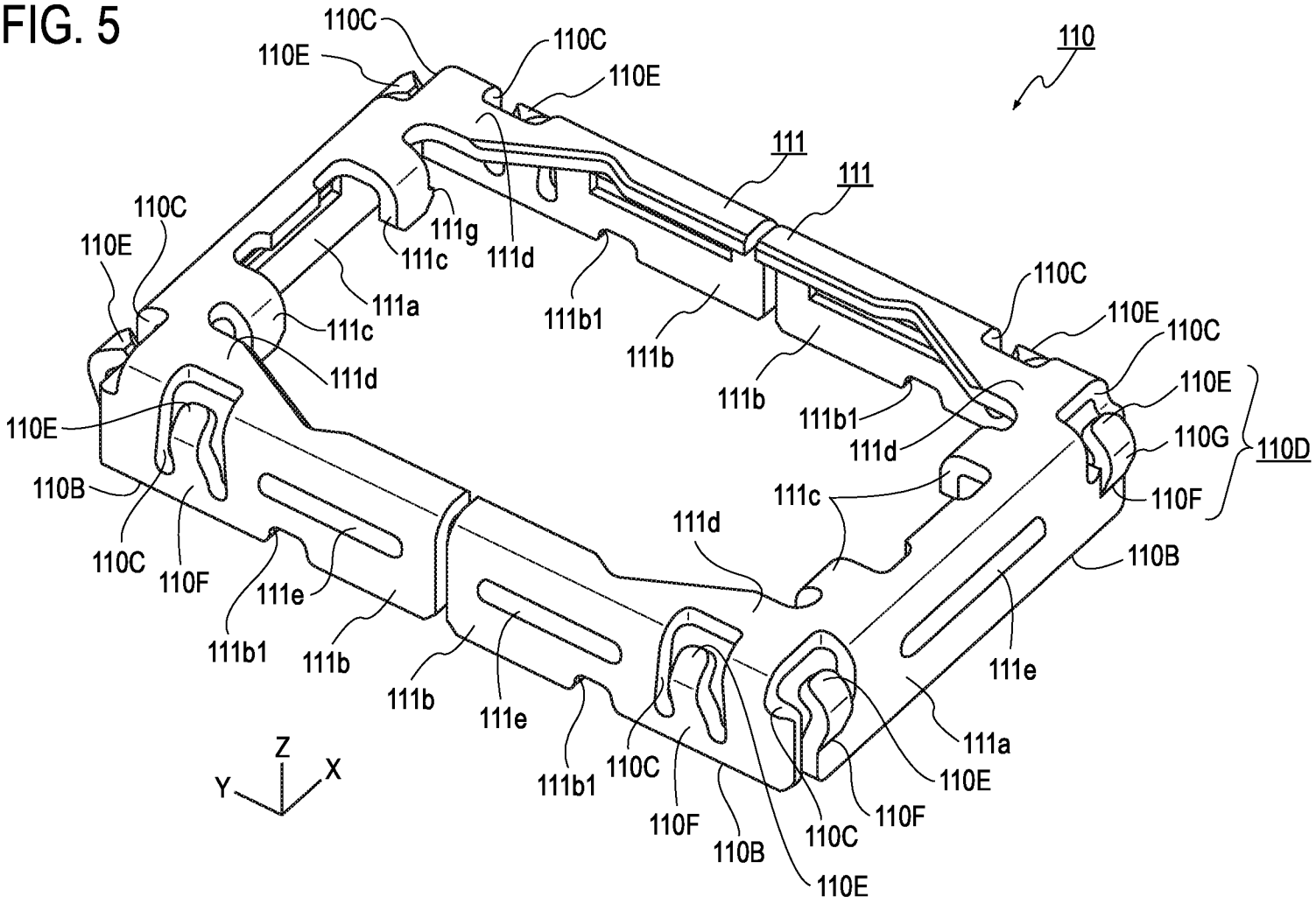
FIG. 5 is a perspective view of a first shell of the first board-to-board connector.

In the following, details of the first shell 110 having these features are described. In this embodiment, the first shell 110 shown in FIG. 5 is constructed of two metal parts 111. The two metal parts 111 have the same structure as one another, so one of the two metal parts 111 will be described.

The one-piece metal part 111 has a staple-like appearance and includes a first plate portion 111*a* shaped like an elongated rectangular plate and two second plate portions 111*b* each shaped like an elongated rectangular plate. The two second plate portions 111*b* extend in the same direction (that is, the Y-direction shown in FIG. 5) from near the opposite ends in the length direction (that is, the X-direction shown in FIG. 5) of the first plate portion 111*a*. An upper end portion of the first plate portion 111*a* and upper end portions of the two second plate portions 111*b* are curved 90 degrees toward the inside of the metal part 111. "Upper" and "lower" in the description refer to "upper" and "lower" on a page in a height direction of the metal parts 111 shown in FIG. 5 (that is, the Z-direction shown in FIG. 5).

One brace 111*d* shaped like a right-angled triangle extends from one end in the length direction at the upper end portion of the first plate portion 111*a* to one end in the length direction at the upper end portion of one second plate portion 111*b*. Another brace 111*d* shaped like a right-angled triangle extends from the other end in the length direction at the upper end portion of the first plate portion 111*a* to one end in the length direction at the upper end portion of the other second plate portion 111*b*. Two hooks 111*c* each shaped like a rectangular plate extend downward from near the opposite ends in the length direction at the upper end portion of the first plate portion 111*a*. The hooks 111*c* each have a claw 111*g* protruding in a direction orthogonal to an extending direction of the hook 111*c*. A lower end portion of the second plate portion 111*b* has a U-shaped notch 111*b*1.

The first plate portion 111*a* has two slits 110C and two cantilever springs 110D at opposite ends of the first plate portion 111*a* in the length direction. A part of the slit 110C provided in the first plate portion 111*a* also defines a gap between the first plate portion 111*a* and the second plate portion 111*b* adjacent to each other which results from bending processing for the metal part 111. The tab-shaped cantilever spring 110D is positioned inside of the slit 110C and has the free end 110E and the fixed end 110F. The cantilever spring 110D extends in the height direction of the first plate portion 111*a* (that is, Z-direction), with the fixed end 110F of the cantilever spring 110D being fixed to the first plate portion 111*a*. The fixed end 110F of the cantilever spring 110D is positioned near a lower end portion of the first plate portion 111*a*, while the free end 110E of the cantilever spring 110D is positioned near an upper end portion of the first plate portion 111*a*.

Similarly, for each of the two second plate portions 111*b*, the second plate portion 111*b* has one slit 110C and one cantilever spring 110D in a part of the second plate portion 111*b* that is positioned near the first plate portion 111*a*. The tab-shaped cantilever spring 110D is positioned inside of the slit 110C and has the free end 110E and the fixed end 110F. The cantilever spring 110D extends in the height direction of the second plate portion 111*b* (that is, Z-direction), with the fixed end 110F of the cantilever spring 110D being fixed to the second plate portion 111*b*. The fixed end 110F of the cantilever spring 110D is positioned near the lower end portion of the second plate portion 111*b*, while the free end 110E of the cantilever spring 110D is positioned near the upper end portion of the second plate portion 111*b*.

The first plate portion 111*a* has a convex portion 111*e* shaped like an elongated half cylinder and protruding toward the outside of the first plate portion 111*a*. The convex portion 111*e* of the first plate portion 111*a* extends in a direction orthogonal to the height direction of the first plate portion 111*a*. Opposite ends of the convex portion 111*e* of the first plate portion 111*a* are somewhat apart from the two cantilever springs 110D of the first plate portion 111*a*, respectively. Similarly, for each of the two second plate portions 111*b*, the second plate portion 111*b* has the convex portion 111*e* shaped like an elongated half cylinder and protruding toward the outside of the second plate portion 111*b*. The convex portion 111*e* of the second plate portion 111*b* extends in a direction orthogonal to the height direction of the second plate portion 111*b*. One end of the convex portion 111*e* of the second plate portion 111*b* is somewhat apart from the cantilever spring 110D of the second plate portion 111*b*.

One of the metal parts 111 is attached to the two side wall portions 132 positioned in one of the two side plate portions 131*b* of the first insulator 130, and the other metal part 111 is attached to the two side wall portions 132 positioned in the other of the two side plate portions 131*b* of the first insulator 130. During the attachment, the hooks 111*c* each having the claw 111*g* are pressed into the concave portions 132*a* in the side wall portions 132. As a result, the two metal parts 111 are attached to the first insulator 130 such that ends of the two second plate portions 111*b* of one metal part 111 and ends of the two second plate portions 111*b* of the other metal part 111 face each other. The two metal parts 111 in such a state constitute the first shell 110. The end portions 170*c* of the rod portion 170*a* of the conductor part 170 are positioned in the U-shaped notches 111*b*1 of the second plate portion 111*b*.

With the first shell 110 being attached to the first insulator 130, the first plate portion 111*a* and the second plate portion 111*b* run along the outside of the first insulator 130. That is, the first plate portion 111*a* and the second plate portion 111*b* correspond to the first side wall portion 110A. The lower end portion of the first plate portion 111*a* and the lower end portions of the two second plate portions 111*b* (but excluding the U-shaped notches 111*b*1) are parts that can be attached to the first board 1 and correspond to the first part 110B. Accordingly, the fixed end 110F of the cantilever spring 110D is close to the first part 110B of the first shell 110, while the free end 110E of the cantilever spring 110D is apart from the first part 110B of the first shell 110.

Each cantilever spring 110D has a curved shape that bulges toward the outside of the first shell 110. A central portion 110G of the cantilever spring 110D positioned between the free end 110E and the fixed end 110F is positioned on the outside of the first side wall portion 110A. The free end 110E of the cantilever spring 110D is not positioned on the outside of the first side wall portion 110A of the first shell 110. Accordingly, when external force in the height direction of the first shell 110 (that is, Z-direction) is applied to the cantilever spring 110D, the cantilever spring 110D is able to tilt to the inside of the first shell 110 with the fixed end 110F as a fulcrum. When the cantilever spring 110D tilts in response to external force, the free end 110E of the cantilever spring 110D enters the concave portion 132*b* in the side wall portion 132. In other words, thanks to the concave portion 132*b* in the side wall portion 132, motion of the cantilever spring 110D is not hindered.

From the viewpoint of blocking the spatial conduction of an electromagnetic wave, it is commonly preferable that a slit in a conductive shell is positioned as far as possible from contacts for high frequency current. However, as is apparent from this embodiment, the slit 110C and the cantilever spring 110D may be positioned closer to the high frequency contacts (that is, the two first contacts 150 attached to the side plate portions 131*b*) than to the low frequency contacts (that is, the six first contacts 150 attached to the center plate portion 131*a*). That is, there are less design constraints on the positions of the slit and the cantilever spring than in the prior art.

The first board-to-board connector 100 is attached to one surface of the first board 1. The one surface of the first board 1 has a ground pad and a signal line. The other ends 150*b* and 150*d* of the first contacts 150 are in contact with the signal line of the first board 1. The rod portion 170*a* of the conductor part 170 and the first part 110B of the first shell 110 are in contact with the ground pad of the first board 1. Typically, the first board-to-board connector 100 is attached to the first board 1 by means of solder.

<Second Board-to-Board Connector>

Figure 6:
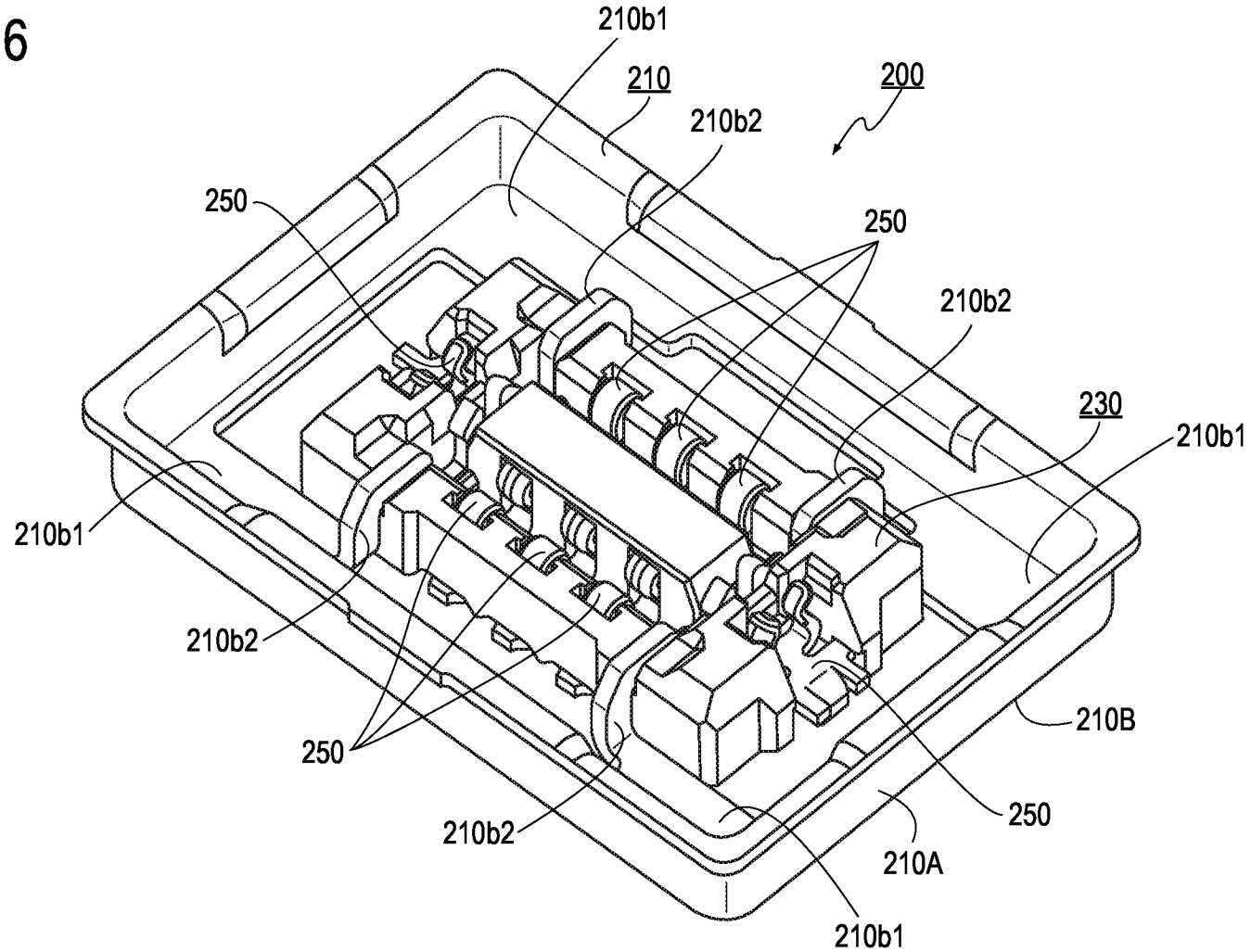
FIG. 6 is a perspective view of a second board-to-board connector when it is seen from diagonally above.
Figure 7:
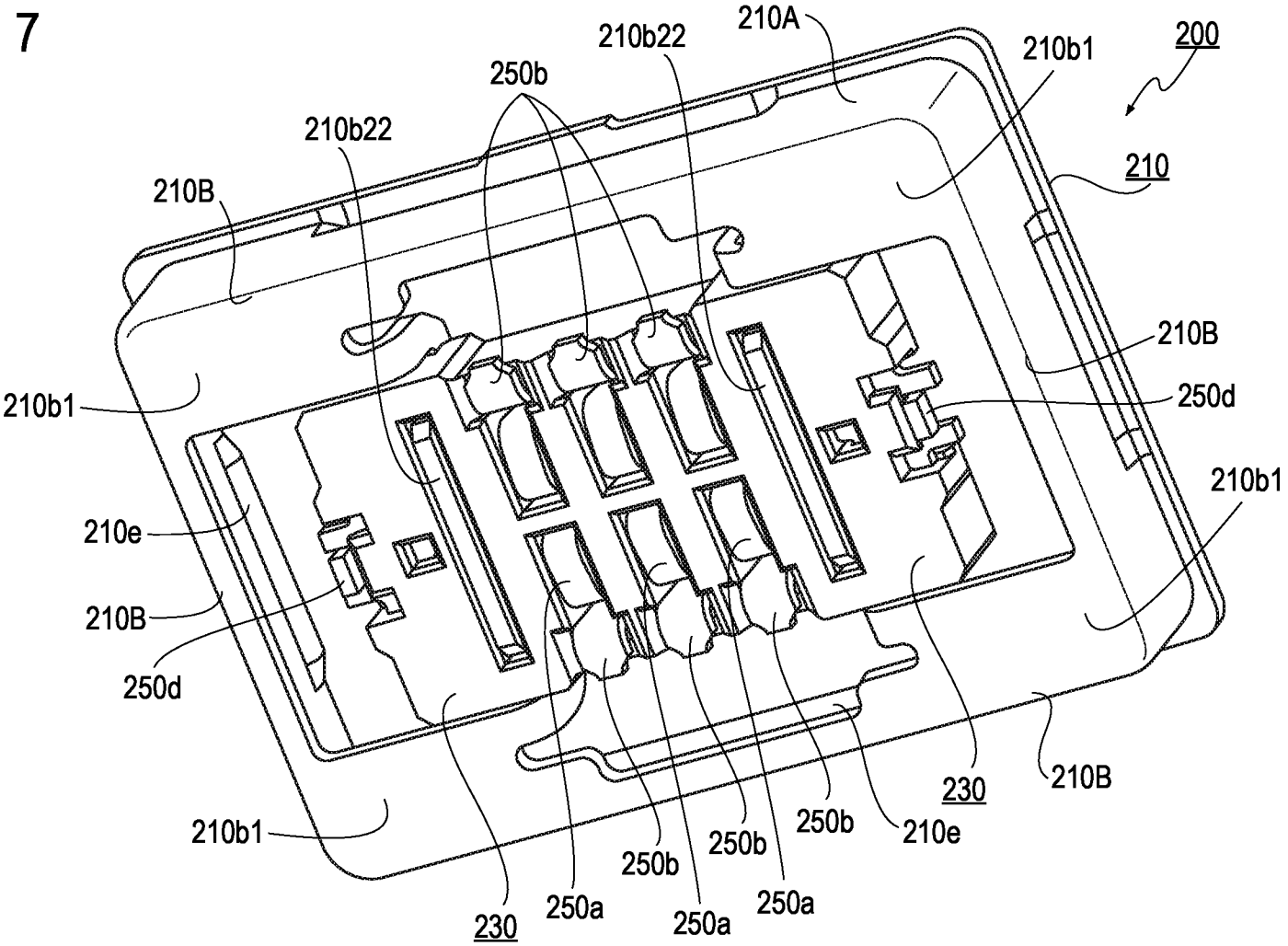
FIG. 7 is a perspective view of the second board-to-board connector when it is seen from diagonally below.

The second board-to-board connector 200 shown in FIGS. 6 and 7 includes a second shell 210 having a frame structure and conductivity, a second insulator 230 having electrical insulation property, and eight second contacts 250 each having conductivity.

<Second Insulator and Second Contact>

Figure 8:
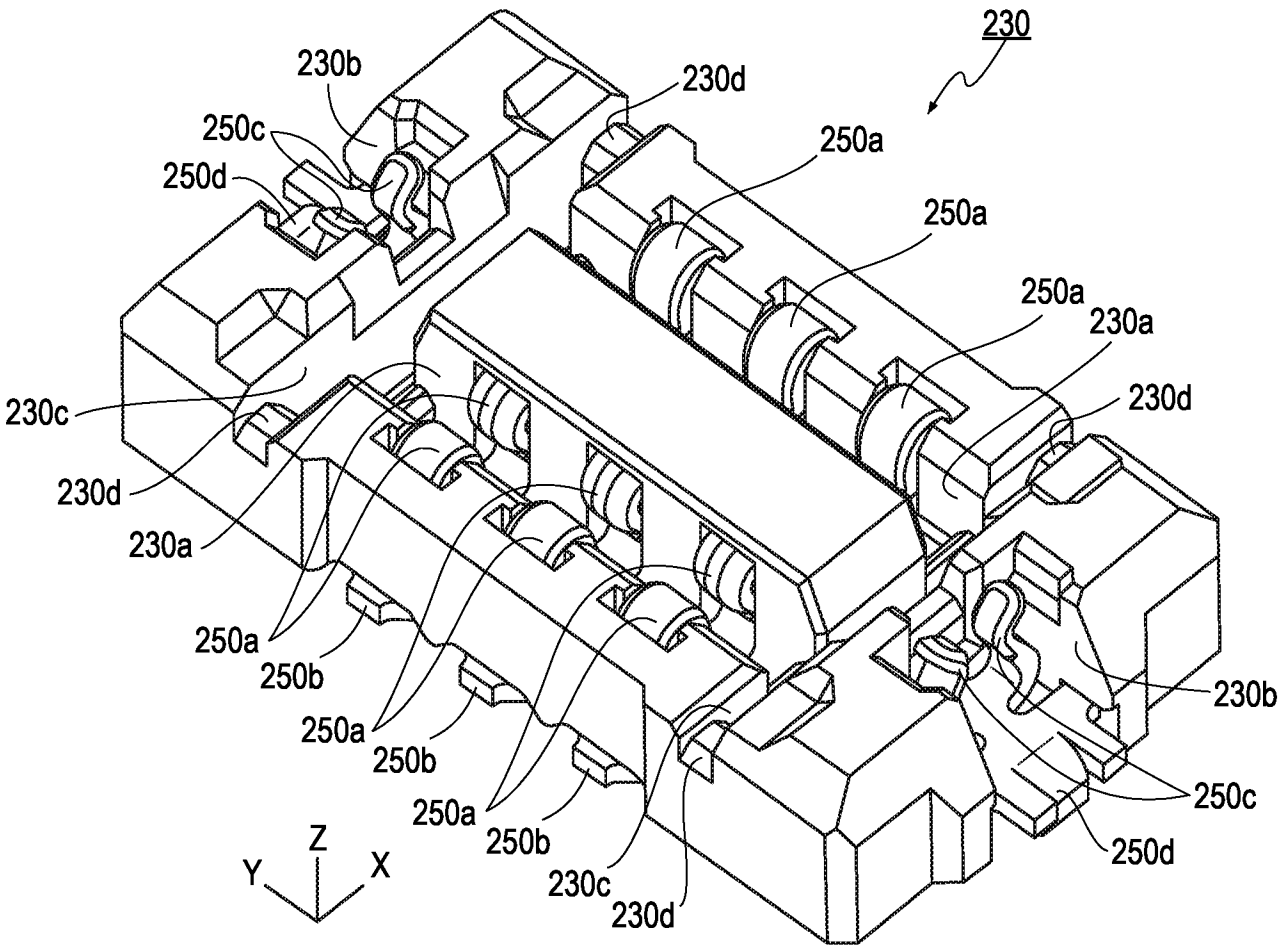
FIG. 8 is a perspective view of a second insulator of the second board-to-board connector.

The second insulator 230 shown in FIG. 8 is a one-piece insulation part and has an appearance of a substantially rectangular parallelepiped. The second insulator 230 has two grooves 230*a* extending in parallel to the length direction of the second insulator 230 (that is, the Y-direction shown in FIG. 8) in a central portion of the second insulator 230. Three second contacts 250 are attached along one groove 230*a* and three second contacts 250 are attached along the other groove 230*a*. Each of these six second contacts 250 is formed from a bent, belt-like metal plate and has a U-shaped portion 250*a* and an L-shaped portion 250*b* extending from one end of the U-shaped portion 250*a*. The U-shaped portion 250*a* of the second contact 250 is positioned in the groove 230*a* in the second insulator 230. The U-shaped portion 250*a* opens upward. "Upper" and "lower" in the description refer to "upper" and "lower" on a page in a height direction of the second insulator 230 shown in FIG. 8 (that is, Z-direction). An end portion of the second contact 250 (that is, an end portion of the L-shaped portion 250*b*) is positioned at a lower end of the side wall in the length direction of the second insulator 230.

The second insulator 230 has two concave portions 230*b* at opposite ends in the length direction of the second insulator 230. The remaining two second contacts 250 are attached to the two concave portions 230*b*. Each of the two second contacts 250 is formed from a bent metal plate and has a U-shaped portion 250*c* and a leg portion 250*d* extending from a bottom portion of the U-shaped portion 250*c*. The U-shaped portion 250*c* opens upward. An end portion of the second contact 250 (that is, an end portion of the leg portion 250*d*) is positioned at the lower end of the side wall in a width direction of the second insulator 230 (that is, X-direction).

The second insulator 230 has a slit 230*c* extending in the width direction of the second insulator 230 between one concave portion 230*b* in which the second contact 250 is positioned and the groove 230*a* in which the six second contacts 250 are positioned and has a slit 230*c* extending in the width direction of the second insulator 230 between the other concave portion 230*b* in which the second contact 250 is positioned and the groove 230*a* in which the six second contacts 250 are positioned. That is, the second insulator 230 has two slits 230*c*.

The second insulator 230 has two bridge portions 230*d* that connect a central portion of the second insulator 230 with one of the two end portions in the length direction of the second insulator 230 and has two bridge portions 230*d* that connect the central portion of the second insulator 230 with the other of the two end portions in the length direction of the second insulator 230. Each of the slits 230*c* is positioned between two bridge portions 230*d*.

<Second Shell>

Figure 9:
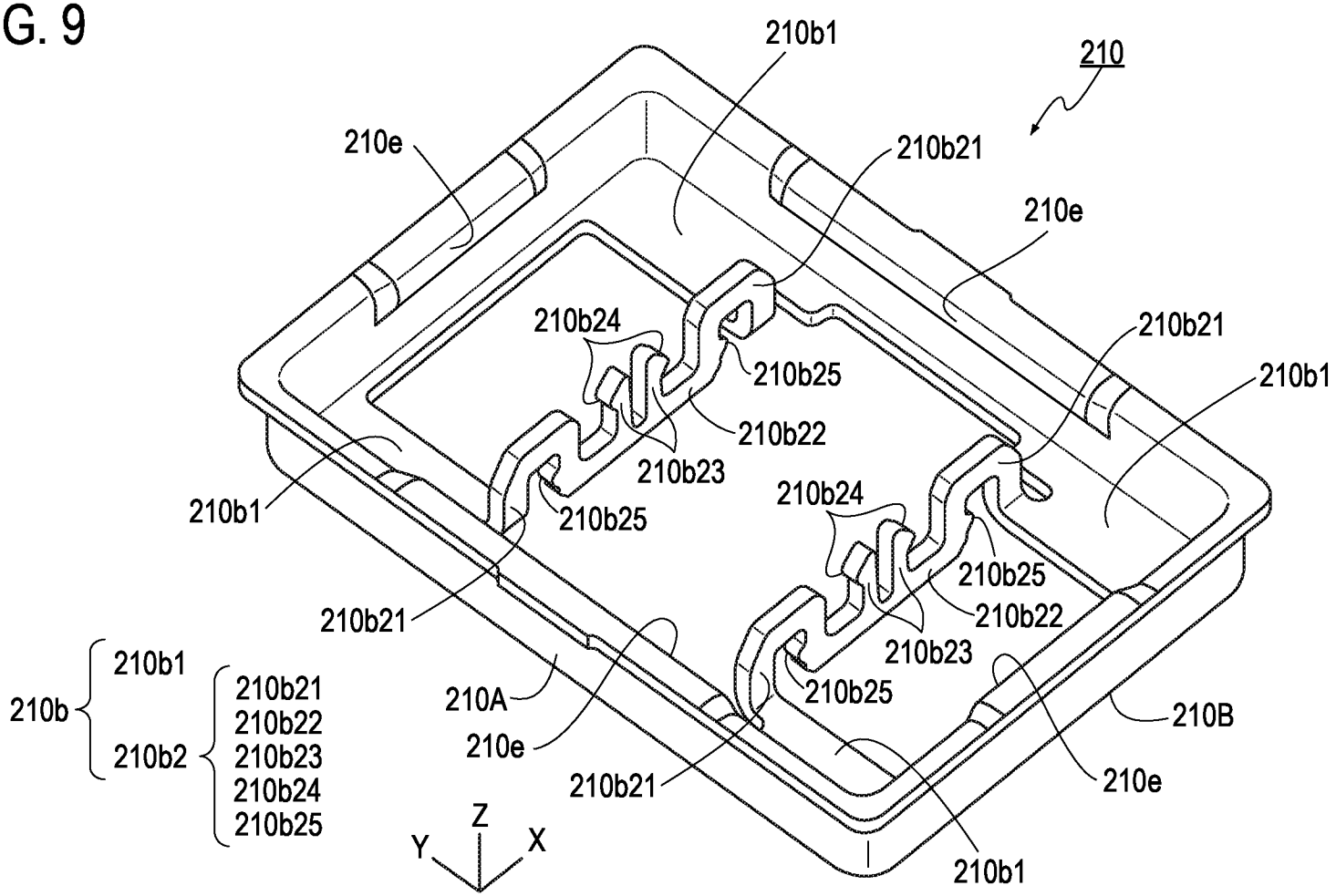
FIG. 9 is a perspective view of a second shell of the second board-to-board connector.

The one-piece second shell 210 shown in FIG. 9 has a bottom portion 210*b*, and a second side wall portion 210A shaped like a rectangular frame and having a second part 210B attachable to the second board 2. The second shell 210 is made of metal. The bottom portion 210*b* has four flat plate portions 210*b*1 and two upright portions 210*b*2. The flat plate portions 210*b*1 are positioned at corner portions of the second side wall portion 210A. Each of the upright portions 210*b*2 extends from one of two flat plate portions 210*b*1 neighboring in the width direction of the second shell 210 (that is, the X-direction shown in FIG. 9) to the other one. Each upright portion 210*b*2 extends in the width direction of the second shell 210 and stands perpendicularly to the bottom portion 210*b*.

Each upright portion 210*b*2 has two reverse U-shaped portions 210*b*21, one bridge portion 210*b*22, and two leg portions 210*b*23. The reverse U-shaped portions 210*b*21 extend perpendicularly from the flat plate portion 210*b*1 toward an upper side of the second shell 210 and further fold back perpendicularly toward a lower side of the second shell 210. "Upper" and "lower" in the description refer to "upper" and "lower" on a page in the height direction of the second shell 210 shown in FIG. 9 (that is, Z-direction). The bridge portion 210*b*22 extends from one reverse U-shaped portions 210*b*21 to the other reverse U-shaped portion 210*b*21. The two leg portions 210*b*23 extend from a central portion of the bridge portion 210*b*22 toward the upper side of the second shell 210. The leg portions 210*b*23 each have a claw 210*b*24 protruding in the width direction of the second shell 210 at an end of the leg portion 210*b*23. Each of the reverse U-shaped portions 210*b*21 has a claw 210*b*25 protruding toward the inside of the reverse U-shaped portion 210*b*21.

Each side of the second side wall portion 210A has a convex portion 210*e* shaped like an elongated half cylinder and protruding toward the outside of the second side wall portion 210A. The convex portion 210*e* extends in a direction orthogonal to the height direction of the second side wall portion 210A.

The second shell 210 is attached to the second insulator 230, resulting in the second insulator 230 being positioned within the second shell 210 (see FIG. 6). At this point, the two upright portions 210*b*2 of the second shell 210 are housed in the two slits 230*c* of the second insulator 230. The bridge portions 230*d* of the second insulator 230 are pressed in between the reverse U-shaped portions 210*b*21 having the claws 210*b*25. The second side wall portion 210A of the second shell 210 surrounds the outside of the second insulator 230. The lower end portion of the second side wall portion 210A of the second shell 210 corresponds to the second part 210B attachable to the second board 2.

The second board-to-board connector 200 is attached to one surface of the second board 2. The one surface of the second board 2 has a ground pad and a signal line. The end portions of the L-shaped portions 250*b* of the six second contacts 250 mentioned above and the end portions of the leg portions 250*d* of the two second contacts 250 mentioned above are in contact with the signal line of the second board 2. The second part 210B of the second shell 210 and the bridge portion 210*b*22 of the second shell 210 are in contact with the ground pad of the second board 2. Typically, the second board-to-board connector 200 is attached to the second board 2 by means of solder.

<Connector Assembly>

Figure 10:
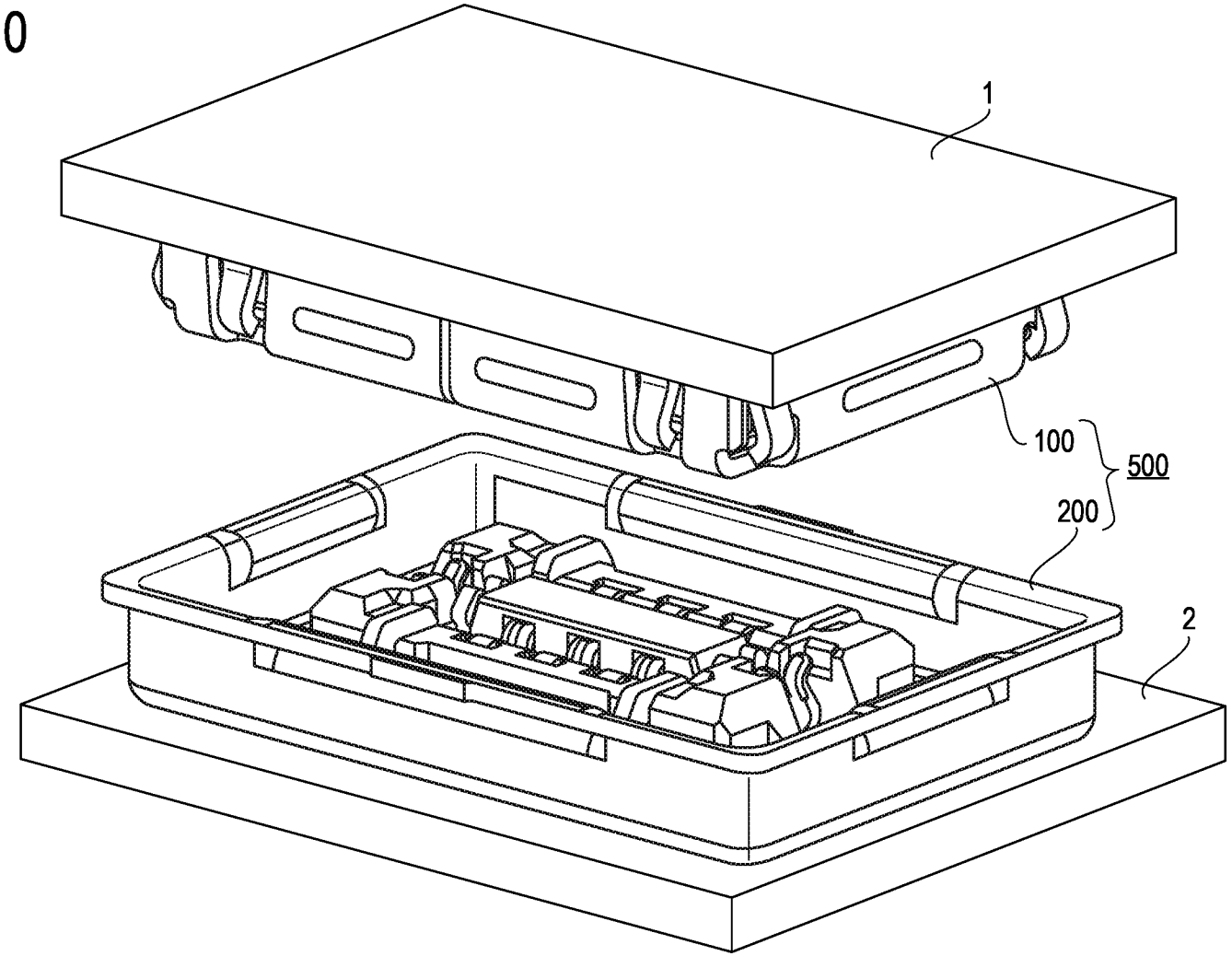
FIG. 10 is a diagram for describing a structure of a connector assembly according to an embodiment.
Figure 11A:
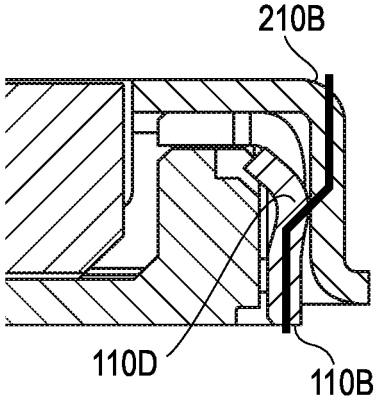
FIG. 11A is a diagram for describing grounding performance in the connector assembly according to the embodiment.
Figure 11B:
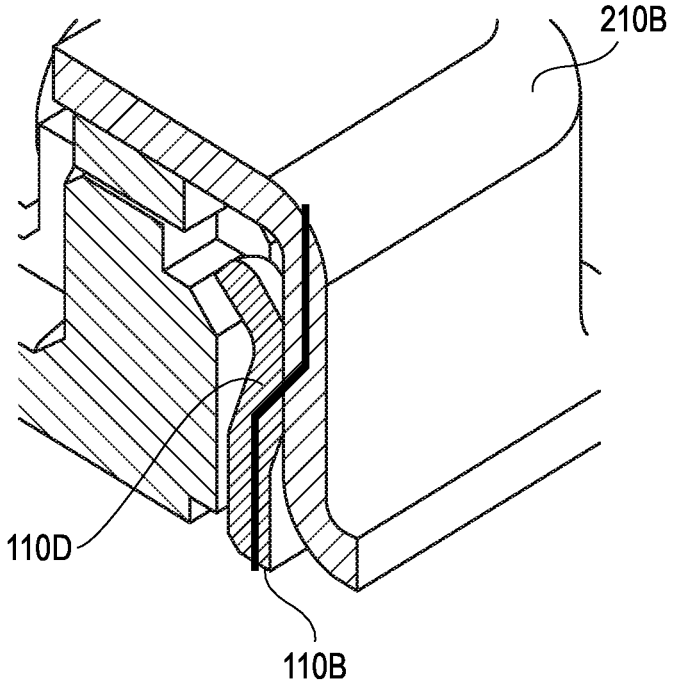
FIG. 11B is a diagram for describing grounding performance in the connector assembly according to the embodiment.

The first board-to-board connector 100 fixed on one surface of the first board 1 and the second board-to-board connector 200 fixed on one surface of the second board 2 fit with each other such that the one surface of the first board 1 and the one surface of the second board 2 face each other in parallel (see FIG. 10). The first board-to-board connector 100 and the second board-to-board connector 200 as fitted with each other constitute the connector assembly 500. The connector assembly 500 achieves parallel connection of the first board 1 and the second board 2 and electrically connects the first board 1 and the second board 2 with each other. In the connector assembly 500, the first shell 110 of the first board-to-board connector 100 is positioned inside of the second shell 210 of the second board-to-board connector 200.

In the connector assembly 500, the one end 150*a* of each of the six first contacts 150 forming the contact rows in the first insulator 130 is fitted in one of the U-shaped portions 250*a* of the six second contacts 250 positioned in the grooves of the second insulator 230. Further, in the connector assembly 500, the one end 150*c* of each of the remaining two first contacts 150 of the first insulator 130 is fitted in one of the U-shaped portions 250*c* of the two second contacts 250 positioned at the opposite ends of the second insulator 230.

In the connector assembly 500, the wall portion 170*b* of the conductor part 170 attached to the first insulator 130 is fitted between the reverse U-shaped portion 210*b*21 and the leg portion 210*b*23 at the upright portion 210*b*2 of the second shell 210. A combination of the conductor part 170 attached to the first insulator 130 and the upright portion 210*b*2 of the second shell 210 serves as a shield that electromagnetically separates the low frequency contacts and the high frequency contact.

In a process in which the first board-to-board connector 100 and the second board-to-board connector 200 are fitted to each other, the convex portion 111*e* of the first shell 110 crosses over the convex portion 210*e* of the second shell 210. In the connector assembly 500, the convex portion 111*e* of the first shell 110 and the convex portion 210*e* of the second shell 210 are in contact with each other. This reduces gaps between the first shell 110 and the second shell 210, thus providing the connector assembly 500 with improved shielding performance.

Further, in the connector assembly 500, each of the cantilever springs 110D of the first board-to-board connector 100 is in contact with the second side wall portion 210A of the second shell 210 of the second board-to-board connector 200. As already described, when external force in the height direction of the first shell 110 is applied to the cantilever spring 110D, the cantilever spring 110D is able to tilt to the inside of the first shell 110 with the fixed end 110F as a fulcrum. Therefore, buckling of the cantilever spring 110D would not occur even though the second shell 210 hits the cantilever spring 110D of the first shell 110 during fitting of the first board-to-board connector 100 to the second board-to-board connector 200.

Figure 12A:
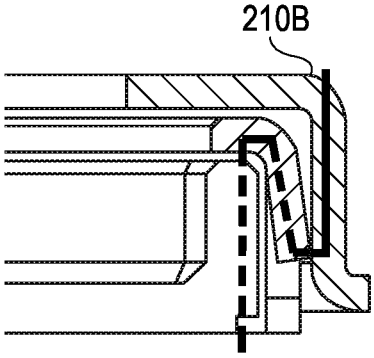
FIG. 12A is a diagram for describing grounding performance in a connector assembly of a conventional form.
Figure 12B:
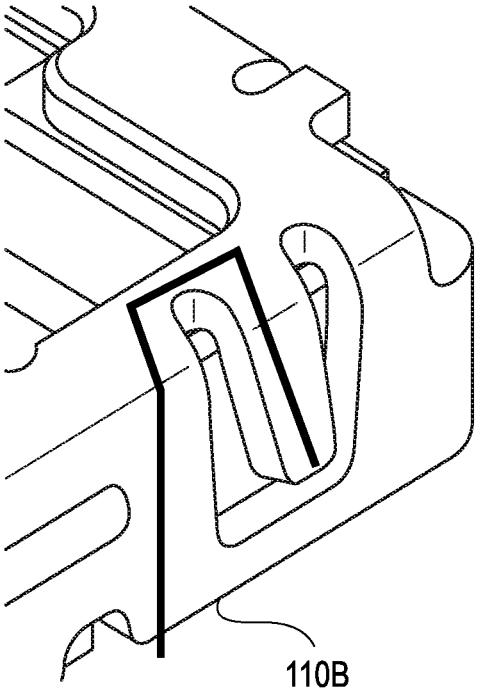
FIG. 12B is a diagram for describing grounding performance in the connector assembly of a conventional form.

According to the foregoing embodiment, the distance from the first part 110B of the first board-to-board connector 100 to the second part 210B of the second board-to-board connector 200 is sufficiently short compared to the distance in the prior art. When the cantilever spring extends in the direction opposite to the direction in which the cantilever spring 110D employed in the above embodiment extends, which is the case in the prior art (see FIG. 12B), the shortest path from the first part 110B of the first board-to-board connector 100 to the second part 210B of the second board-to-board connector 200 is in the shape of a Z with a folding-back portion as illustrated by bold solid lines in FIGS. 12A and 12B. The path indicated by the bold dashed line in FIG. 12A is the same as the path indicated by the bold solid line in FIG. 12B. According to the foregoing embodiment, the shortest path from the first part 110B of the first board-to-board connector 100 to the second part 210B of the second board-to-board connector 200 is of a stepped shape without a folding-back portion as illustrated by bold solid lines in FIGS. 11A and 11B. Accordingly, the cantilever spring 110D according to the embodiment exhibits good grounding performance. That is, reduction in EMI is achieved in the connector assembly 500.

Figure 13:
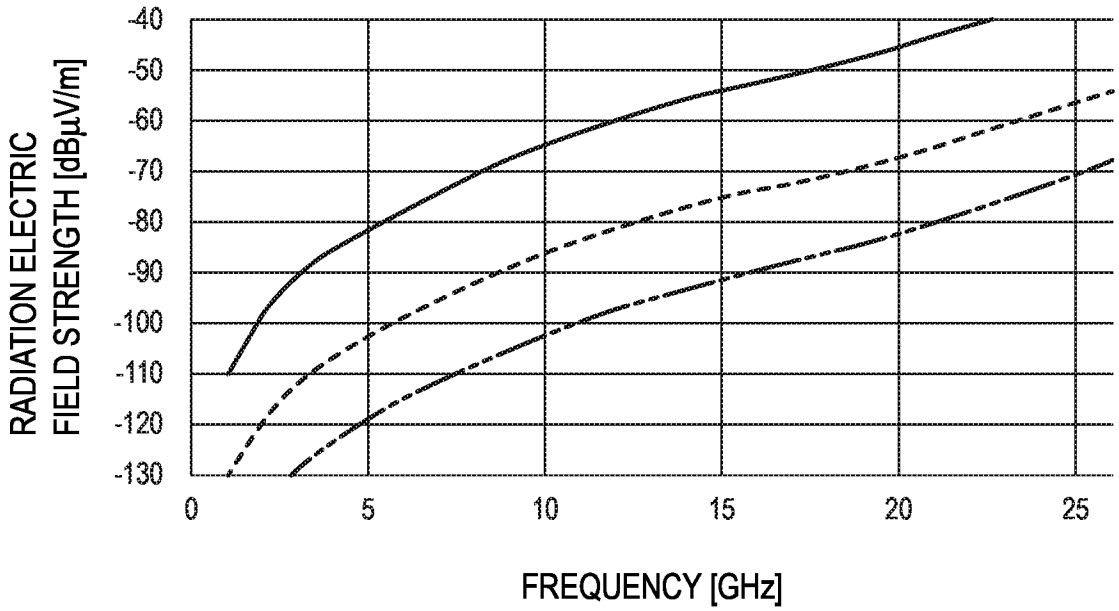
FIG. 13 is a graph for describing EMI in the connector assembly according to the embodiment.

FIG. 13 shows graphs of EMI for the connector assembly 500 according to the embodiment and each of first and second comparative examples. The vertical axis of the graphs represents radiation electric field strength (unit: dBμV/m) and the horizontal axis represents frequency (unit: GHz). The first comparative example has the same structure as the connector assembly 500 except that the cantilever springs extend in the direction opposite to the direction in which the cantilever springs 110D employed in the above embodiment extend. The second comparative example has the same structure as the connector assembly 500 except that the cantilever springs 110D employed in the above embodiment are not present. The solid line in the graph represents the radiation electric field strength of the first comparative example, the dashed line represents the radiation electric field strength of the second comparative example, and the chain double-dashed line represents the radiation electric field strength of the connector assembly 500. From comparison between the connector assembly 500 and the first comparative example, it can be seen that EMI in the connector assembly 500 is significantly mitigated by employing the cantilever springs 110D which extend in the direction opposite to the direction in which the cantilever springs employed in the prior art extend. Moreover, from comparison between the connector assembly 500 and the second comparative example, it can be seen that combination of the cantilever spring 110D with a gap reduction structure based on the contact between the convex portion 111*e* of the first shell 110 and the convex portion 210*e* of the second shell 210 significantly mitigates EMI in the connector assembly 500.

<Addendum>

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims.

Moreover, the use of the terms "first", "second", "i-th", etc., if any, do not denote any order or importance, but rather the terms "first", "second", "i-th", etc. are used to distinguish one element from another. The term "first" does not necessarily mean "coming before all others in order". The terminology used herein is for the purpose of describing particular embodiments only and is not intended to limit the invention in any way. As used herein, the singular forms "a", "an" and "the" are intended to include the plural forms as well, unless the context clearly indicates otherwise. It will be further understood that the terms "comprise", "comprises", and/or "comprising," when used in this specification and/or the appended claims, specify the presence of stated features, steps, operations, elements, and/or components, but do not preclude the presence or addition of one or more other features, steps, operations, elements, components, and/or groups thereof. The same goes for "include", "includes", and/or "including". The term "and/or", if any, includes any and all combinations of one or more of the associated listed items. In the claims and the specification, unless otherwise noted, "connect", "join", "couple", "interlock", or synonyms therefor and all the word forms thereof, if any, do not necessarily deny the presence of one or more intermediate elements between two elements, for instance, two elements "connected" or "joined" to each other or "interlocked" with each other. Connection between elements, if required, may be physical connection, electrical connection, or a combination thereof. In the claims and the specification, unless otherwise noted, the term "arbitrary", if any, should be understood as a term having the same meaning as the universal quantifier V. For example, the expression "for arbitrary X" has the same meaning as "for every X" or "for each X".

Unless otherwise defined, all terms (including technical and scientific terms) used herein have the same meaning as commonly understood by those skilled in the art to which the invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual techniques or steps in an unnecessary fashion. Nevertheless, the specification and claims should be read with the understanding that such combinations are entirely within the scope of the invention and the claims.

The corresponding structures, materials, acts, and equivalents of all means or step plus function elements in the claims below, if any, are intended to include any structure, material, or act for performing the function in combination with other claimed elements as specifically claimed.

The foregoing description of the embodiments of the invention has been presented for the purpose of illustration and description. It is not intended to be exhaustive and to limit the invention to the precise form disclosed. Modifications or variations are possible in light of the above teaching. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A board-to-board connector attachable to a board, the board-to-board connector comprising:

a shell having a frame structure and conductivity;

an insulator having electrical insulation property; and at least one contact having conductivity, the at least one contact being attached to the insulator, the shell being attached to the insulator, the insulator being positioned within the shell, the shell having a side wall portion that runs along the insulator, the side wall portion of the shell having a part that is attachable to the board, the side wall portion of the shell having a slit, the side wall portion of the shell having a cantilever spring that is positioned in the slit and that has a free end and a fixed end fixed to the side wall portion of the shell, the cantilever spring extending in a height direction of the shell, the fixed end of the cantilever spring being close to the part of the shell, and the free end of the cantilever spring being apart from the part of the shell.

2. The board-to-board connector according to claim 1, wherein the cantilever spring has a curved shape that bulges toward an outside of the shell, a part of the cantilever spring is positioned on an outside of the side wall portion of the shell, the part being positioned between the free end and the fixed end, and the free end of the cantilever spring is not positioned on the outside of the side wall portion of the shell.

3. The board-to-board connector according to claim 1, wherein the side wall portion of the shell has a convex portion protruding toward an outside of the shell, and the convex portion extends in a direction orthogonal to the height direction of the shell.

4. The board-to-board connector according to claim 2, wherein the side wall portion of the shell has a convex portion protruding toward the outside of the shell, and the convex portion extends in a direction orthogonal to the height direction of the shell.

5. The board-to-board connector according to claim 1, wherein the at least one contact includes at least two contacts, at least one contact of the at least two contacts is a high frequency contact for high frequency current, at least one contact of the at least two contacts but excluding the high frequency contact is a low frequency contact for low frequency current, and the cantilever spring is closer to the high frequency contact than to the low frequency contact.

6. The board-to-board connector according to claim 2, wherein the at least one contact includes at least two contacts, at least one contact of the at least two contacts is a high frequency contact for high frequency current, at least one contact of the at least two contacts but excluding the high frequency contact is a low frequency contact for low frequency current, and the cantilever spring is closer to the high frequency contact than to the low frequency contact.

7. The board-to-board connector according to claim 3, wherein the at least one contact includes at least two contacts, at least one contact of the at least two contacts is a high frequency contact for high frequency current, at least one contact of the at least two contacts but excluding the high frequency contact is a low frequency contact for low frequency current, and the cantilever spring is closer to the high frequency contact than to the low frequency contact.

8. The board-to-board connector according to claim 4, wherein the at least one contact includes at least two contacts, at least one contact of the at least two contacts is a high frequency contact for high frequency current, at least one contact of the at least two contacts but excluding the high frequency contact is a low frequency contact for low frequency current, and the cantilever spring is closer to the high frequency contact than to the low frequency contact.

9. A connector assembly comprising:

a first board-to-board connector attachable to a first board; and a second board-to-board connector attachable to a second board and fitted with the first board-to-board connector, wherein the first board-to-board connector includes a first shell having a frame structure and conductivity, a first insulator having electrical insulation property, and a first contact having conductivity, the first contact is attached to the first insulator, the first shell is attached to the first insulator, the first insulator is positioned within the first shell, the first shell has a first side wall portion that runs along the first insulator, the first side wall portion of the first shell has a first part that is attachable to the first board, the first side wall portion of the first shell has a slit, the first side wall portion of the first shell has a cantilever spring that is positioned in the slit and that has a free end and a fixed end fixed to the first side wall portion of the first shell, the cantilever spring extends in a height direction of the first shell, the fixed end of the cantilever spring is close to the first part of the first shell and the free end of the cantilever spring is apart from the first part of the first shell, the second board-to-board connector includes a second shell having a frame structure and conductivity, a second insulator having electrical insulation property, and a second contact having conductivity, the second contact is attached to the second insulator, the second shell is attached to the second insulator, the second insulator is positioned within the second shell, the second shell has a second side wall portion surrounding the second insulator, the second side wall portion of the second shell has a second part that is attachable to the second board, and in the connector assembly in which the first board-to-board connector and the second board-to-board connector are fitted with each other, the first shell of the first board-to-board connector is positioned inside of the second shell of the second board-to-board connector, and the cantilever spring of the first board-to-board connector is in contact with the second side wall portion of the second shell of the second board-to-board connector.

* * * * *